US005799722A

United States Patent [19]

Buziashvili et al.

[11] Patent Number: 5,799,722

[45] Date of Patent: Sep. 1, 1998

[54] METHOD AND APPARATUS FOR CONTINUOUS METAL CASTING

[76] Inventors: Boris Buziashvili, 43-24 43rd St., Apt. 1B, Sunnyside, N.Y. 11104; Zurab Buziashvili, 515 E. 86th St., New York, N.Y. 10028

[21] Appl. No.: 585,692

[22] Filed: Jan. 16, 1996

Related U.S. Application Data

[63] Continuation-in-part of Ser. No. 397,877, Mar. 2, 1995, abandoned.

[51] Int. Cl.[6] ..... B22D 11/04

[52] U.S. Cl. ..... 164/478; 164/416; 164/440; 164/490

[58] Field of Search ..... 164/478, 490, 164/416, 440

[56] References Cited

U.S. PATENT DOCUMENTS

| | | | |
|---|---|---|---|
| 2,134,091 | 10/1938 | Stecher . | |
| 2,446,752 | 8/1948 | Fiddyment . | |
| 2,481,131 | 9/1949 | Lindsay | 198/769 |
| 3,045,299 | 7/1962 | Steigerwald . | |
| 3,053,379 | 9/1962 | Roder et al. . | |
| 3,203,264 | 8/1965 | Evans . | |
| 3,348,664 | 10/1967 | Renner . | |
| 3,415,306 | 12/1968 | Olsson | 164/416 X |
| 3,796,299 | 3/1974 | Musschoot . | |
| 4,088,223 | 5/1978 | Bertrand | 198/761 |
| 4,498,518 | 2/1985 | Hasebe et al. . | |
| 4,694,886 | 9/1987 | Sakaguchi | 164/416 |
| 4,972,970 | 11/1990 | Toerner . | |
| 4,999,021 | 3/1991 | Reissmann . | |
| 5,127,512 | 7/1992 | Frolich et al. . | |
| 5,355,935 | 10/1994 | Nogues | 164/416 |

FOREIGN PATENT DOCUMENTS

| | | | |
|---|---|---|---|
| 2805277 | 8/1979 | Germany | 164/440 |
| 54-15424 | 2/1979 | Japan | 164/490 |
| 1792796 | 2/1993 | U.S.S.R. | 164/416 |

OTHER PUBLICATIONS

Translation of U.S.S.R. Inventor's Certificate Published Feb. 7, 1993.

*Primary Examiner*—J. Reed Batten, Jr.
*Attorney, Agent, or Firm*—Antonelli, Terry, Stout & Kraus, LLP

[57] ABSTRACT

Material is fed in a feed direction along an assembly vibrations are simultaneously applied to the assembly in both a direction at an acute angle to the feed direction and in a direction along the feed direction. The vibration is preferably applied in both directions using two vibrators with the same working phase. The productivity of the apparatus is increased, the quality of the continuous cast considerably improved and the continuity of the process is insured as compared with known methods and apparatus.

19 Claims, 4 Drawing Sheets

Z
Z
1
2
3
4
5
a
α
A
6
10
9
8
7
15
X
a y
y
1
3
4
a
e
10
9
8
a
X

METHOD AND APPARATUS FOR CONTINUOUS METAL CASTING

RELATED APPLICATIONS

This application is a continuation in part of application Ser. No. 08/397,877 filed Mar. 2, 1995 now abandoned.

FIELD OF THE INVENTION

The present invention is directed to an improved method and apparatus for continuous casting. More particularly, the invention relates to continuous casting machines of horizontal and inclined types.

BACKGROUND OF THE INVENTION

A known method of continuous, horizontal metal casting by Krupp Industries involves oscillating a block made of a liquid metal receiver and a crystallizer at a frequency of 360 cycles/min., e.g. 6 Hertz. The continuously cast metal is drawn from the crystallizer with a constant speed. In this known method of continuous, horizontal metal casting, the oscillatory movement of the liquid metal receiver and crystallizer is in a longitudinal direction along the technological casting line, e.g. along the central longitudinal axis of the crystallizer. This known method is disadvantageous in that the continuous cast metal can have a non-homogeneous structure because of an absence of rotation and mixing of the liquid-core of the cast in the crystallizer, which prevents asymmetric crystallization. It is also difficult to stabilize the process of forming and growing the outer core of the cast metal in this known method and apparatus as they do not allow fixation of the beginning point of metal crystallization in the crystallizer and of the section at which the destruction of hardening core begins. Problems of shrinkage, causing breaking of the core, formation of cracks and tearing of the metal can also occur because of inconsistencies of the required feeding of the liquid metal to the crystallizer.

USSR Patent No. 1,792,796 issued Feb. 7, 1993, discloses a method of continuous metal casting and a machine for its realization which attempt to avoid the aforementioned disadvantages associated with the known Krupp Industries' method of continuous, horizontal casting. The method of continuous metal casting and the apparatus therefor disclosed in the USSR patent involve feeding a liquid metal stream from the metal receiver into the connected crystallizer by applying vibration and by drawing the cast. Vibration is supplied in a single direction along a straight line crossing the crystallizer's longitudinal axis in the place of the joint between the liquid metal receiver and the crystallizer. The shock-absorbing flatness is positioned along the longitudinal axis of the crystallizer. The longitudinal axis of the vibrator attached to the metal receiver is shifted horizontally relative to the longitudinal axis of the crystallizer and is positioned at an acute angle to it. This provides cyclical movement for metal particles of not yet hardened metal on the surface of the fireproof connecting sleeve of the apparatus.

The quality of the casting produced with this known method is improved over that produced by the aforementioned method of Krupp Industries. However, the method and continuous metal casting machine of USSR Patent No. 1,792,796 are especially disadvantageous where it is desired to obtain adequate oscillation force on the joint of the metal receiver and crystallizer for the purpose of shifting the crystallization front along the casting axis to a location beyond the fireproof connecting sleeve in order to improve continuous cast quality and to provide continuity of the process. In such case, the obtaining of adequate oscillation force in the desired plane may cause the destroying of the metal receiver fettling and as a result will defile all of the end product with non-metal recrements. There is a need for an improved method and apparatus for continuous metal casting which produce a high quality continuous metal while providing continuity of the process.

Further, illustrative of the prior art of continuous casting utilizing vibration are U.S. Pat. Nos. 2,134,091; 3,045,299 and 4,498,518.

SUMMARY OF THE INVENTION

An object of the invention is to provide an improved method and apparatus for continuous metal casting which, on one hand, provide homogeneous structure of the cast with a high quality of the cast outer surface as well as the cast crystal inner structure, and on the other hand, provide continuity of the process.

More particularly, an object of the invention is to provide an improved method and apparatus for continuous metal casting which reduce the danger of causing metal receiver fettling destruction and the consequent defiling of the cast product with the non-metal recrements resulting therefrom.

These and other objects are attained by the apparatus of the invention for continuous casting, of horizontal and inclined types, the apparatus comprising an assembly for containing a material being cast, which material is fed in a feed direction along the assembly during casting, and means for simultaneously applying vibration to the assembly in both a direction at an acute angle to the feed direction and in a direction along the feed direction, wherein feed direction is coincident with casting axis direction.

The assembly of the apparatus according to the disclosed, preferred embodiment of the invention includes a receiver for receiving molten metal as the casting material and a crystallizer connected to the receiver and into which crystallizer a liquid metal stream from the receiver is fed in the feed direction for solidification and from which crystallizer cast metal is continuously drawn. The crystallizer is connected to the receiver via a fireproof connecting sleeve. With equal significance of applied forces in each of the aforementioned directions, the resultant of these applied vibrations concentrating on the surface of the connecting sleeve is more than two times greater than the like force applied only at any one of these directions and it enables shifting the crystallization front beyond the connecting sleeve while at the same time not destroying the metal receiver fettling.

The means for simultaneously applying vibration in the disclosed, preferred embodiment of the invention includes two sources of vibration and means for simultaneously transmitting vibration from each source to the assembly in respective ones of the direction at an acute angle to the casting axis and the direction along the casting axis direction. The sources of vibration are two electromagnetic vibrators which during the work have the same phase such that the vibrators transmit vibrations in the respective directions accordingly. The power of each of the electromagnetic vibrators is the same in the disclosed embodiment. The power of each vibrator can be equal to half the power of the vibrator used in the continuous casting apparatus disclosed in the aforementioned USSR Patent No. 1,792,796, wherein vibration is applied only in one direction at an acute angle to the casting axis. As a result of the applied vibrations in the two directions from the two vibrators, with the apparatus of the invention and the related method, it is possible to achieve summary resultant force on the joint of the metal receiver with the crystallizer, which is more than two times greater than a like force applied only in any one of the directions.

If a force equal to the power of this resultant force was attempted from only one vibrator position in a direction at an acute angle to the casting axis, the danger is that in this case the attained vibration will increase the possibility of metal receiver fettling destruction, thus increasing the possibility of defiling the end product with non-metal recrements.

The disclosed apparatus also comprises means for resiliently supporting the assembly so that it can oscillate in response to the application of the vibration by the means for simultaneously applying vibration. This means for resiliently supporting includes shock absorbers. The attachment of the vibrators to the assembly varies with the different types of horizontal and inclined continuous casting machines. With horizontal and inclined continuous casting machines, wherein metal receiver and crystallizer are connected sideways, the vibrators and shock absorbers are attached to the metal receiver. With horizontal and inclined continuous casting machines, wherein the crystallizer is connected to the metal receiver from underneath the latter by means of flat springs, the vibrators are attached to the crystallizer.

A further feature of the apparatus of the invention is that the direction at an acute angle to the feed direction in which vibration is applied is along an axis which crosses the crystallizer longitudinal axis at a joint of the crystallizer and the metal receiver as seen in a side elevational view of the apparatus and is horizontally shifted relative to the longitudinal axis and arranged at an acute angle thereto. This provides cyclical movement for metal particles of not yet hardened metal on the surface of the fireproof connecting sleeve of the apparatus thereby improving the quality of the casting.

A method of the invention for continuous casting comprises providing an assembly for containing a material being cast such that the material can be fed in a feed direction along the assembly and simultaneously applying vibration to the assembly in both a direction at an acute angle to the feed direction and in a direction along the feed direction. The advantageous results from this method are referred to above. The method can be practiced with the apparatus of the invention as disclosed herein.

These and other objects, features and advantages of the present invention will become more apparent from the following detailed description of several embodiments according to the present invention.

DESCRIPTION OF DISCLOSED EMBODIMENT

Figure 1:
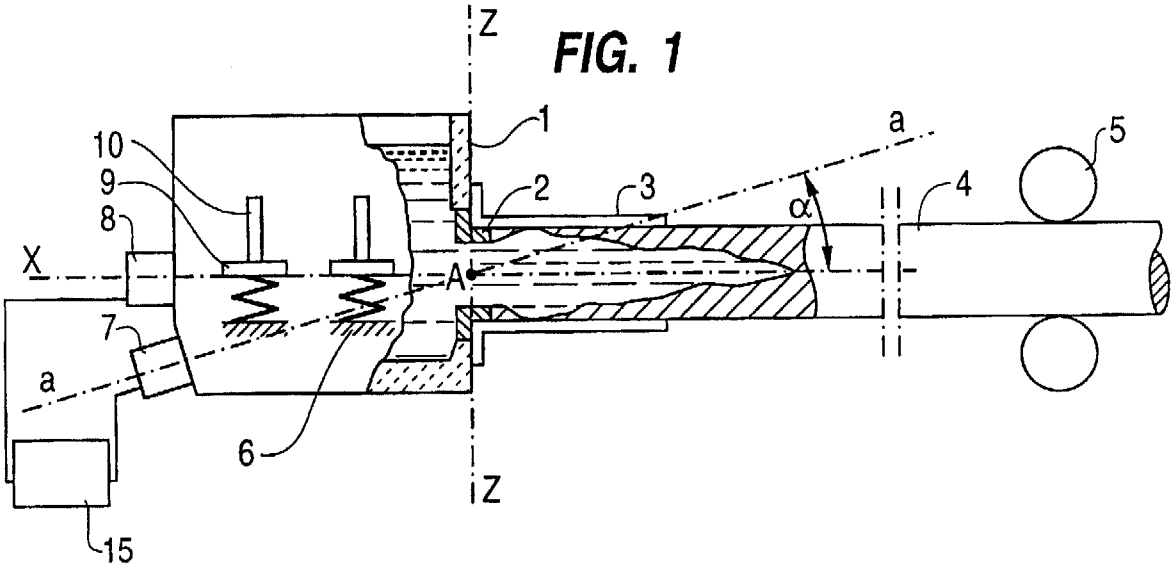
FIG. 1 is a schematic, side elevational view, partially in cross-section, taken along the longitudinal axis X—X of the crystallizer, of a horizontal continuous metal casting apparatus wherein metal receiver and crystallizer are connected sideways.
Figure 2:
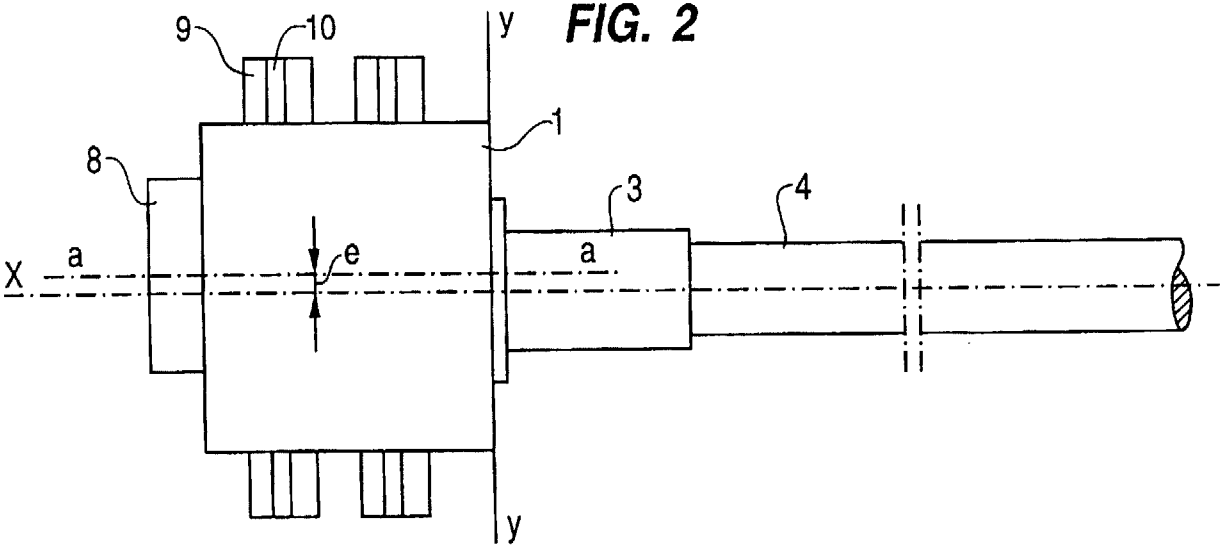
FIG. 2 is a top view of the casting apparatus of FIG. 1.

Referring now to the drawings, the continuous metal casting apparatus of the invention depicted in FIGS. 1 and 2 comprises an assembly for containing and shaping a material being cast, the assembly comprising a molten metal receiver 1 from which metal is fed through a connecting sleeve 2 into a crystallizer 3 of the assembly that is being water-cooled and to all of these vibration is applied from vibrator 7 and vibrator 8. The cast 4 drawing is realized by draw unit 5.

The vibration from vibrator 8 is applied along the casting axis, e.g. the feed direction, which is coincident with the longitudinal axis X—X of the crystallizer 3, and the vibration from vibrator 7 is applied in a direction along an axis a—a, crossing the longitudinal axis X—X of the crystallizer 3 at an acute angle $\alpha$ therewith in the center A of the joint between the crystallizer 3 and the receiver 1 as seen in the side elevational view of the continuous metal casting apparatus shown in FIG. 1. As shown in FIG. 2, the axis a—a is also shifted a distance e in the horizontal plane relative to longitudinal axis X—X of the crystallize 3.

The receiver 1 is supplied with shock absorbers 6 with brackets 10, the bearing surfaces 9 of which are positioned in a plane passing through the longitudinal axis X—X. The vibrators 7 and 8 are electromagnetic vibrators which produce oscillations which are applied to the receiver 1 and the connecting sleeve 2 and crystallizer 3 in respective ones of both of the aforementioned directions. The frequency of oscillation of the vibrators can be 60 or 120 herts. Associated amplitude at this frequency can be 0.1 mm or 0.05 mm, accordingly. With the higher frequency of 120 herts, the associated amplitude could be lower, ~0.05 mm. The oscillations of the two vibrators 7 and 8 are in phase with one another by way of common control 15 schematically depicted in FIG. 1. It is important to mention that with the suggested invention the power of each said vibrator should be equal half the power of the vibrator, described in the prior art invention of the USSR patent No. 1,792,796 issued Feb. 7, 1993, wherein the vibration from single vibrator is applied only in one direction at an angle to crystallizer casting axis.

For example, to be able to achieve similar results as in prior art invention (referring to the vibratory force, quality of the cast and continuity of the process) it was required to use the vibrator with 1 KW power according to the prior art invention. With the suggested invention to achieve the same results, it is required to use two vibrators, each with the power of 0.5 KW for application of oscillation forces in two aforementioned directions. The suggested invention is being superior to prior art invention in that it insures the obtaining of the required vibratory force in crystallizer (not in metal-receiver) thus protecting the metal receiver fettling from destruction, which prevents possible non-metal recrements in the end product, thus improving the cast quality and providing continuity of the process.

For operation of the continuous metal casting apparatus of the invention shown in FIG. 1, after the filling of the receiver 1 with liquid metal the vibrators 7 and 8 are switched on and simultaneously the draw unit 5 is switched on. Cast metal which has hardened on a primer starts to move along the crystallizer towards the draw unit 5. The impact of vibration in both of the aforesaid directions, as depicted in FIG. 6, not only prevents forming of junctions in the continuous casting process on the joint of the fireproof sleeve and the crystallizer, but also efficiently causes the receiver with the attached crystallizer to work as a vibrofeeder for feeding liquid metal into the crystallizer and reducing the resistance to drawing the cast from the crystallizer, which is not possible in the case when oscillatory movement is applied only along the casting axis, longitudinal axis X—X.

Figure 4:
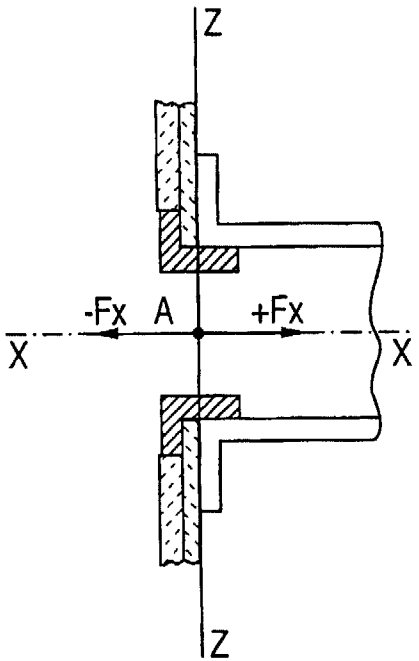
FIG. 4 is an enlarged view of a portion of the cross-section of the continuous metal casting apparatus shown in FIG. 1 taken at the joint of the crystallizer and the metal receiver and showing the actions of vibration forces in a direction along the longitudinal axis X—X of the crystallizer in the plane XAZ.
Figure 5:
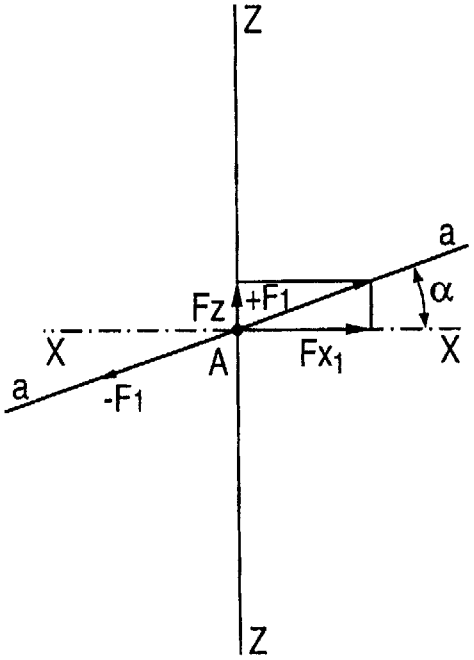
FIG. 5 is a view similar to FIG. 4 but showing the action of oscillation forces in the plane XAZ in a direction along the axis a—a at an acute angle $\alpha 0$ to the longitudinal axis X—X of the crystallizer.
Figure 6:
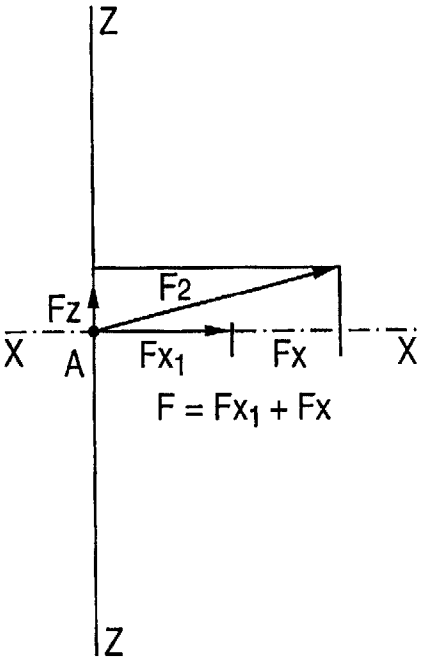
FIG. 6 is a view similar to FIGS. 4 and 5, but showing the action of oscillation forces in plane XAZ in both the aforesaid directions simultaneously, e.g. in directions along longitudinal axis X—X and along the axis a—a.
Figure 7:
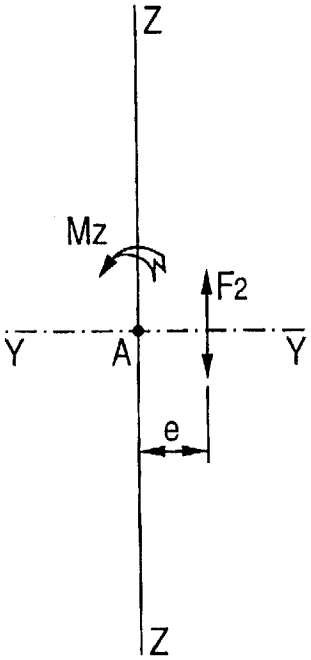
FIG. 7 shows the action of the forces of FIG. 6 in the flatness YAZ, when the force $F_z$, being on a distance e from the crystallizer center A creates a turning moment $M_z$, where $M_z=F_z \times e$, providing the circulatory movements of the not yet hardened metal particles on the surface of the connecting sleeve.

For comparison, the action of oscillation forces in the plane XAZ is shown in FIG. 4 for oscillation forces acting only along the longitudinal casting axis, e.g. axis X—X, is shown in FIG. 5 for oscillation forces acting only at an acute angle $\alpha$ to the longitudinal axis X—X along the line a—a, and is shown in FIG. 6 for oscillation forces acting simultaneously in both directions, e.g. along the longitudinal axis X—X and along the line a—a, respectively, according to the present invention. FIG. 7 shows the action of forces in the plane YAZ when the oscillation is applied in both the aforesaid directions according to the invention, when the force $F_z$, being shifted from the crystallizer center A for distance e, creates a turning moment $M_z=F_z\times e$, providing circulatory movements of the not yet hardened metal particles on the surface of the connecting sleeve.

It is clear from a comparison of these figures that with equal significance of applied forces in both directions as in FIG. 6, the resulting force $F_2$ as shown in FIG. 6 is more than two times greater than the force $F_1$ in the case of vibration directed only at an acute angle $\alpha$ to the longitudinal axis X—X as depicted in FIG. 5. This significantly greater resultant force $F_2$ with the present invention as depicted in FIG. 6 creates the possibility to shift the crystallization front behind the connecting sleeve, thus providing obtaining of an improved quality cast and providing continuity of the process.

With the invention, each formed crystallite during casting is being effected by longitudinal force $F=Fx_1+Fx$ and by rotatory-oscillatory force Fz, see FIGS. 6 and 7. The combined action of forces F and Fz insures:

(1) the tearing off of the formed crystallites from the surface of the fireproof connecting sleeve along with the shifting of the crystallization front behind it, e.g. further along axis X—X past the connecting sleeve, which eliminates the forming of the junctions on the surface of the cast;

(2) the mixing of liquid heart-core of the cast and with that providing the cast symmetrical crystallization, as by application of a magnetic field, but with considerably less energy expenditure;

(3) the achievement of better filling of the crystallizer cavity by liquid metal eliminates shrinkage, that being a cause of breaking the core, formation of cracks and tearing of the metal;

(4) the considerable lessening of friction between crystallizer and cast;

(5) the elimination of pauses in the process of cast drawing; and (6) eliminates the possibility of metal receiver fettling destruction, thus preventing the defiling of the end product by non-metal recrements. All of the above mentioned increase the productivity of the continuous metal casting apparatus and improve the quality of the cast outer surface and its crystal structure.

Figure 3:
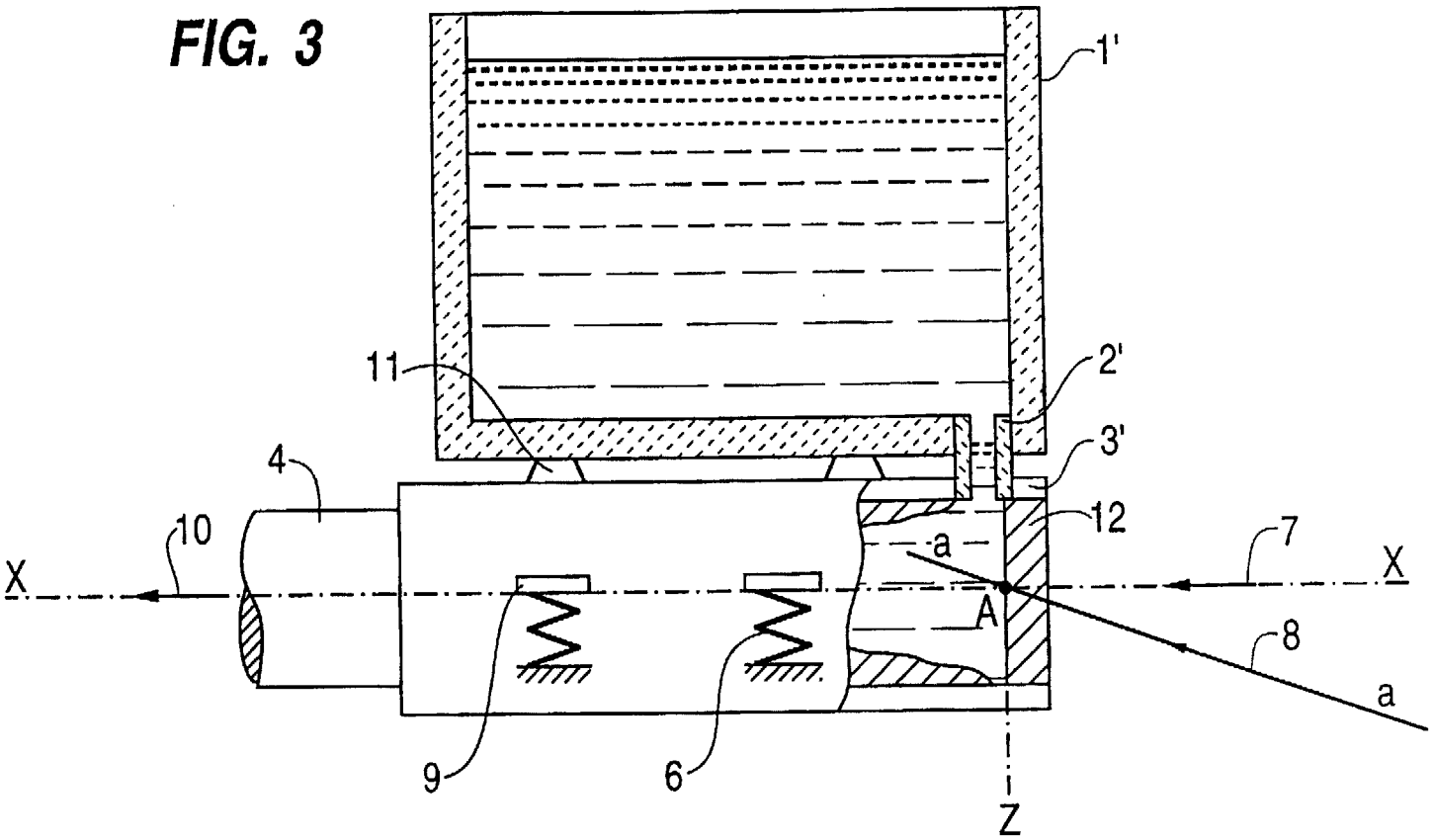
FIG. 3 is a schematic, side elevational view, partially in cross-section, taken along the longitudinal axis X—X of the crystallizer, of a horizontal type continuous metal casting apparatus wherein the crystallizer is attached to the metal receiver underneath through the flat shock-absorbing springs.

Referring to the embodiment in FIG. 3, the assembly of the horizontal continuous casting apparatus comprises a molten metal receiver 1', connecting sleeve 2' and crystallizer 3'. Oscillation forces and their respective directions are applied to the crystallizer 3' as indicated by the arrows 7' and 8' from respective vibrators which are attached to the fireproof inwall 12 of the crystallizer 3'. Flat shock-absorbing springs 11 interconnect the molten metal receiver 1' and the crystallizer 3'.

The apparatus shown in FIG. 3 provides an advantage over the apparatus of FIGS. 1 and 2 in that it also allows production of hollow billets with the help of a water-cooled mandrel, not shown. Operation of the continuous metal casting apparatus of the invention in FIG. 3 is like that described above with respect to the embodiment in FIGS. 1 and 2.

Figure 8:
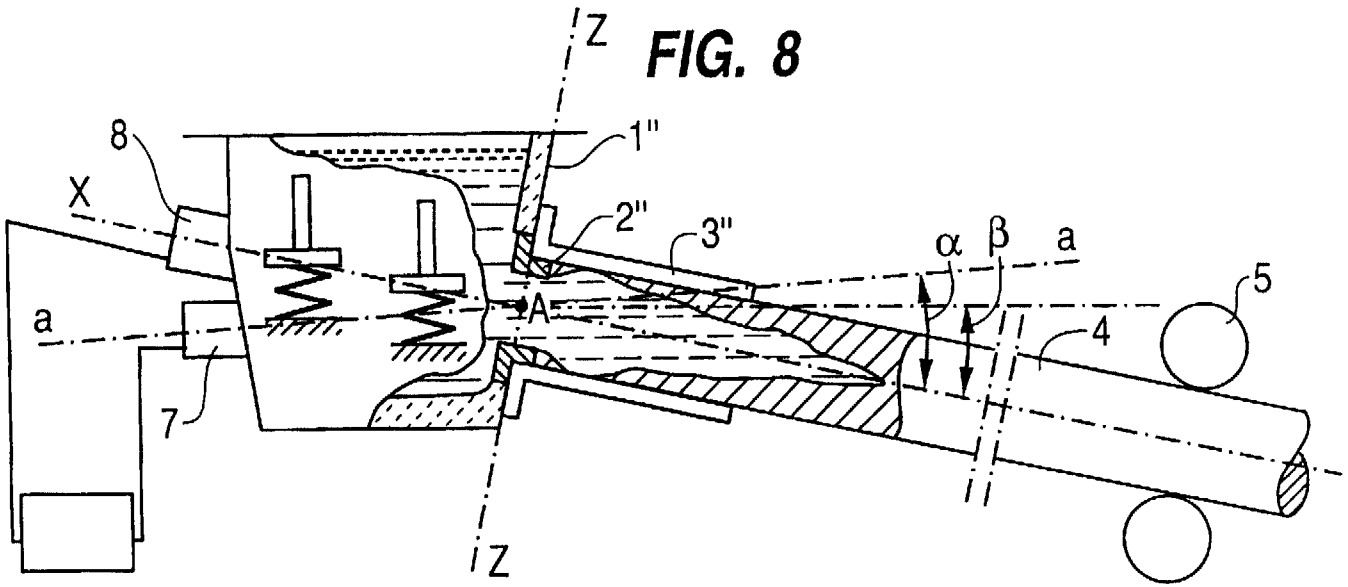
FIG. 8 is a schematic, side elevational view, partially in cross-section , taken along the longitudinal axis X—X of the crystallizer, of an inclined type continuous metal casting apparatus wherein metal receiver and crystallizer are connected sideways.

FIG. 8 is a schematic side elevational view, partially in cross-section, taken along the longitudinal axis X—X of the crystallizer, of an inclined type continuous metal casting apparatus according to a third embodiment of the invention. In this embodiment, the longitudinal axis X—X of the crystallizer 3" makes an angle $\beta$ with respect to the horizontal. The construction and operation of this apparatus is otherwise like that described above with respect to the embodiment in FIGS. 1 and 2.

While we have shown and described only several embodiments in accordance with the present invention, the invention is not limited to the disclosed embodiments, but could be used in connection with various other arrangements for horizontal or inclined continuous metal casting. Therefore, we do not wish to be limited to the details shown and described herein but intend to encompass the method and apparatus of the invention as described in the accompanying claims.

We claim:

1. An apparatus for continuous casting, said apparatus comprising an assembly for containing and shaping a material being cast, said material being fed in a feed direction along said assembly during casting, and means for simultaneously applying vibration to said assembly in both a direction at an acute angle to said feed direction and in a direction along said feed direction with the action of said vibration in both said directions combining to provide a resulting vibratory force greater than the vibratory force associated with the vibration in either one of said both directions to efficiently cause said assembly to work as a vibrofeeder for feeding a liquid material being cast.

2. An apparatus according to claim 1, further comprising means for resiliently supporting said assembly so that it can oscillate in response to application of said vibration by said means for simultaneously applying vibration.

3. An apparatus according to claim 1, wherein said means for simultaneously applying vibration includes two sources of vibration and means for transmitting vibrations from said two sources of vibration to said assembly in respective ones of said direction at an acute angle to said feed direction and said direction along said feed direction.

4. An apparatus according to claim 1, wherein said assembly includes a receiver for receiving molten metal as said casting material and a crystallizer connected to the receiver and into which crystallizer a liquid metal stream from the receiver is fed in said feed direction for solidification and from which crystallizer cast metal is continuously drawn.

5. An apparatus according to claim 4, wherein said crystallizer is connected to said receiver via a fireproof connecting sleeve.

6. An apparatus according to claim 4, wherein said feed direction is along a longitudinal axis of said crystallizer and wherein said direction at an acute angle to said feed direction is along an axis which crosses said crystallizer longitudinal axis at a joint of the crystallizer and the metal receiver as seen in a side elevational view of said apparatus and is horizontally shifted relative to said longitudinal axis and arranged at said acute angle thereto for providing both a longitudinal force and a rotary-oscillatory force about the longitudinal axis to the material during casting.

7. An apparatus according to claim 4, further comprising shock absorbers for supporting said assembly to permit vibration thereof and bearing surfaces on said assembly for engaging said shock absorbers, said bearing surfaces being positioned in a plane which extends along a longitudinal axis of said crystallizer.

8. An apparatus according to claim 4, wherein said apparatus is a horizontal, continuous metal casting machine.

9. An apparatus according to claim 4, wherein said apparatus is an inclined, continuous metal casting machine.

10. An apparatus according to claim 4, wherein said means for simultaneously applying vibration includes two electromagnetic vibrators which are attached to said assembly so as to apply vibration to said receiver and crystallizer in respective ones of each of said directions.

11. An apparatus according to claim 10, including means for operating said two electromagnetic vibrators so that they have the same working phase.

12. An apparatus according to claim 10, wherein each of said two electromagnetic vibrators has the same power.

13. An apparatus according to claim 10, wherein said metal receiver and said crystallizer are connected sideways, and wherein said vibrators are attached to the metal receiver.

14. An apparatus according to claim 13, further comprising shock absorbers for supporting said assembly to permit vibration thereof and bearing surfaces on said metal receiver for engaging said shock absorbers, said bearing surfaces being positioned in a plane which extends along said longitudinal axis of said crystallizer.

15. An apparatus according to claim 10, wherein said crystallizer is connected to said metal receiver underneath the latter by means of flat springs and wherein said two vibrators are attached to said crystallizer.

16. An apparatus for continuous casting, said apparatus comprising an assembly for containing and shaping a material being cast, said material being fed in a feed direction along said assembly during casting, a first device for applying vibration to said assembly in a direction at an acute angle to said feed direction such that a force in the feed direction and a rotary-oscillatory force about the feed direction are provided to the material during casting, a second device for applying vibration to said assembly in a direction along said feed direction, and a control for providing that said vibrations applied to said assembly by said first and second devices are in phase with one another so that the action of said vibration in both said directions combine to provide a resulting force greater than the vibratory force associated with the vibration in either one of said both directions to efficiently cause said assembly to work as a vibrofeeder for feeding a liquid material being cast and reducing resistance to drawing a cast material from said assembly.

17. A method for continuous casting, said method comprising providing an assembly for containing and shaping a material being cast such that said material can be fed in a feed direction along said assembly, feeding a material being cast alone said assembly in said feed direction, and simultaneously applying vibration to said assembly in both a direction at an acute angle to said feed direction and in a direction along said feed direction with the action of said vibration in both said directions combining to provide a resulting vibratory force greater than the vibratory force associated with the vibration in either one of said both directions to efficiently cause said assembly to work as a vibrofeeder for feeding said material being cast.

18. A method according to claim 17, wherein said material being cast is metal and said assembly includes a molten metal receiver and a crystallizer connected to said receiver and into which crystallizer a liquid metal stream from the receiver is fed in said feed direction for solidification and from which crystallizer cast metal is continuously drawn.

19. A method according to claim 16, wherein said feed direction is along a longitudinal axis of said crystallizer and wherein said direction at an acute angle to said feed direction is along an axis which crosses said crystallizer longitudinal axis at a joint of the crystallizer and the metal receiver as seen in a side elevational view of said assembly and is horizontally shifted relative to said longitudinal axis and arranged at said acute angle thereto.

* * * * *